United States Patent [19]

Syfritt

[11] 3,930,274

[45] Jan. 6, 1976

[54] ASSEMBLY FOR USE IN RECREATIONAL ACTIVITIES

[76] Inventor: Harold A. Syfritt, 2221 Vista Drive, Manhattan Beach, Calif. 90266

[22] Filed: Oct. 11, 1974

[21] Appl. No.: 513,981

Related U.S. Application Data

[62] Division of Ser. No. 229,096, Feb. 18, 1972, Pat. No. 3,846,858.

[52] U.S. Cl. ..... 9/2 A; 150/51; 220/12

[51] Int. Cl.[2] ..... B63B 7/08

[58] Field of Search ..... 9/2 A, 2 C, 2 S, 11 A; 114/61, 66.5 F, 121, 123; 220/12; 150/51

[56] References Cited

UNITED STATES PATENTS

| | | | |
|---|---|---|---|
| 2,546,396 | 3/1951 | Jenkins | 9/2 A |
| 3,064,370 | 11/1962 | Fleur | 114/123 |
| 3,601,076 | 8/1971 | Meeks | 9/2 A |

*Primary Examiner*—Duane A. Reger
*Assistant Examiner*—Sherman D. Basinger
*Attorney, Agent, or Firm*—Neil F. Markva

[57] ABSTRACT

The assembly includes a longitudinal axis and opposite end surfaces transverse to the longitudinal axis. The container has a structure effective to receive both liquids and gas mediums therein and has valves for introducing and exhausting both liquid and gas mediums. An elongated frame structure has a plurality of parallel linear support members wherein each support member is laterally spaced with respect to any other lateral support member, and a separate end frame portion connected at each end of the support members to form an open structural configuration for receiving the collapsible container. The elongated container is fastened to the frame structure with the longitudinal axis thereof disposed substantially parallel to the linear support members and each of the end surfaces of the container being disposed adjacent an end frame portion to support the container within the frame structure during use. The container is attached to the frame structure with one of the linear support members extending longitudinally along one side of the container with the opposing side of the container being free of a support member. The assembly may be used as a pontoon when the container is inflated with a gas fluid medium and is employable in other uses such as a fresh water reservoir, a ballast, a sea anchor, a pitch and roll stabilizer and the like when the container is not inflated or holdls a liquid fluid medium.

7 Claims, 12 Drawing Figures

FIG. 1
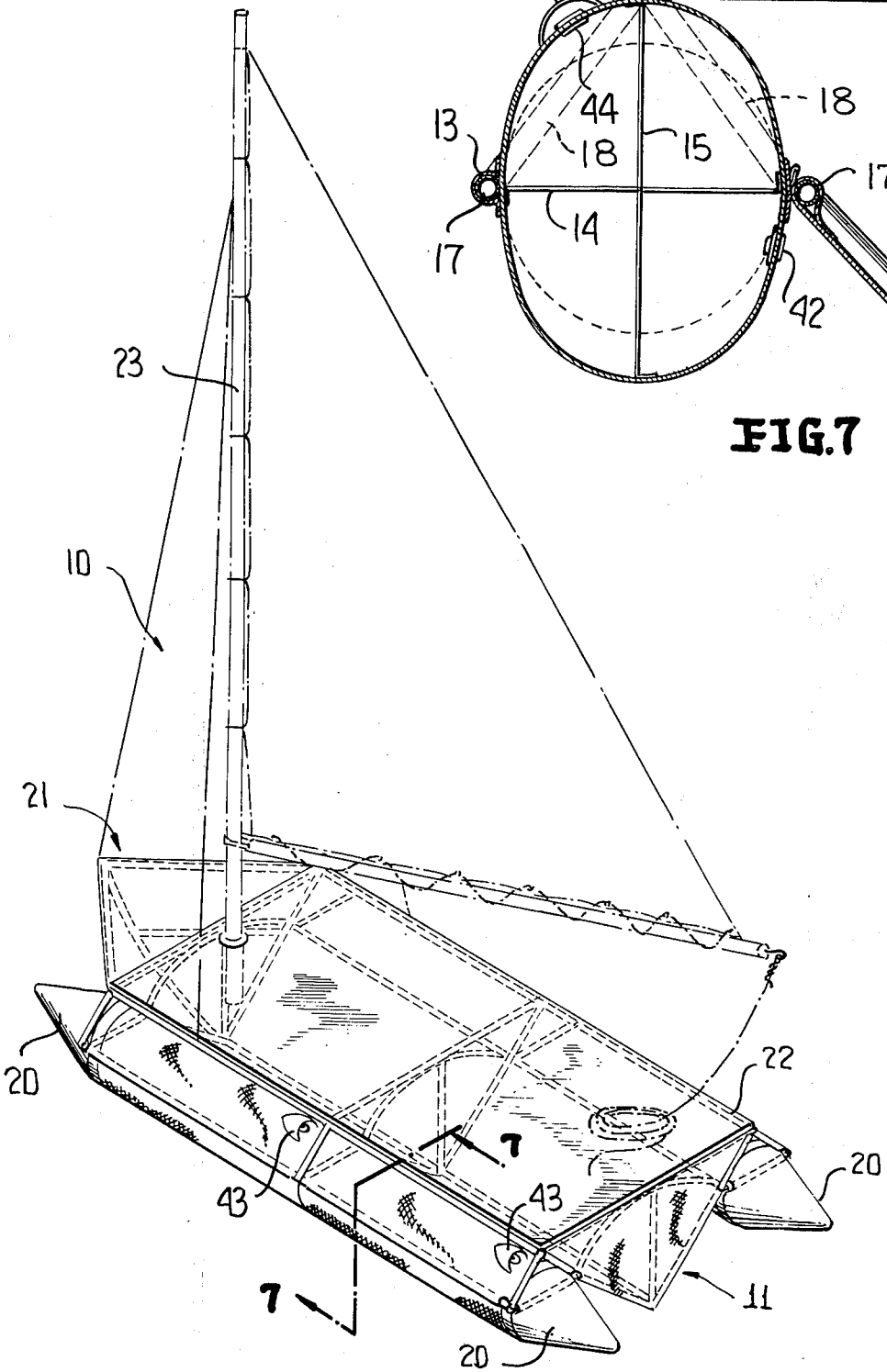
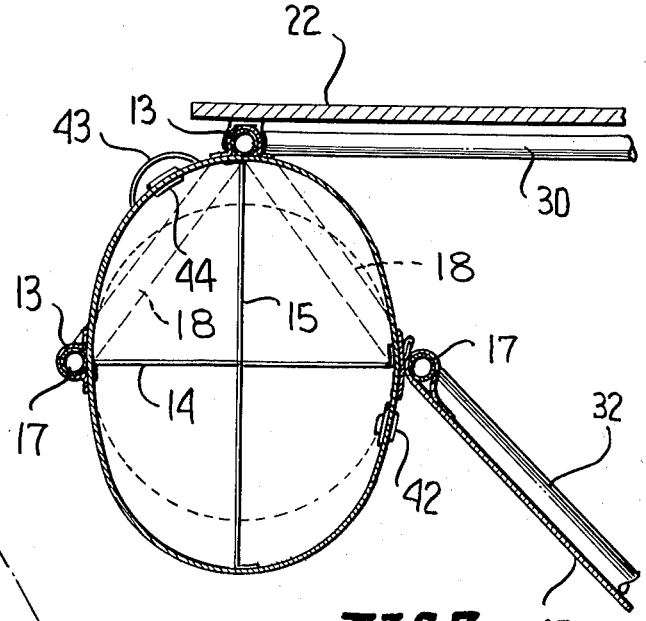
FIG. 7

SEE FIG.6
4
5

ASSEMBLY FOR USE IN RECREATIONAL ACTIVITIES

STATUS OF THE APPLICATION

This application is a divisional application of my parent application Ser. No. 229,096 filed Feb. 18, 1972 and now U.S. Pat. No. 3,846,858.

BACKGROUND OF THE INVENTION

This invention relates to an assembly usable as a boat or as an accessory with sailboats and powerboats and may be employed for many purposes to add to the comfort, convenience and safety of the boating public. The assembly may also be used as a vehicle on land or ice.

It is known in the prior art to use the weight of water as a counterbalance or ballast in a sailboat. Furthermore, there are many different types of accessories which may be employed for different uses. For example, liquid storage tanks, portable showers, pontoons, lifting mechanisms, sea anchors and pitch and roll stabilizers are all available in the prior art. A boatsman who wishes to have the benefits of all these accessories must necessarily have the storage room available on board his boat. The presence of all these different types of accessories creates an obvious problem aboard whether the boat is at dock or underway. Therefore, it is likely that some of these items would not be placed on board by the boatsman. Consequently, it is very likely that safety risks would not be mitigated in any way and that some inconveniences would be suffered by the boatsman.

Where a boat is anchored offshore, it is necessary to have some sort of dinghy so that the boatsman may get back and forth between the shore and his boat. Until now, it was necessary for the boatsman to purchase an additional small boat which must be either placed on board or left anchored at the offshore location. When left at the offshore location, there is obviously no further use that may be attributed to such an accessory.

Finally, there is a marked increase in the number of people who are water sport enthusiasts. Consequently, there are many unskilled people participating in activities in this area. They are demanding equipment which will provide them both with fun and relaxation without their being exposed to a high safety risk. In addition, it is human nature to tire quickly of performing the same kind of activity again and again. In other words, people maintain their interest in certain activities when there is a variety of experiences opened to them. For example, the prior art now provides inflatable boats on which a motor or a sail may be placed for movement. Collapsible catamaran assemblies are available. Collapsible pontoon structures which may be inflated on location are also available in the prior art. These prior art structures provide a means for the consumer to have a fairly small investment and provide him with a highly transportable device for enjoying his water sports. However, each of these prior art assemblies provides only one type of activity. Until now, no construction has been available wherein the recreational enthusiast may also perform several different functions by effecting a simple mechanical manipulation thereto.

PURPOSE OF THE INVENTION

The primary object of this invention is to provide a convertible assembly which may provide a variety of experiences to the water enthusiast along with enhancing the convenience and safety of the boating public and also provide a vehicle for land and ice.

Another object of this invention is to provide a convertible assembly which may be used to effectuate desired results requiring the use of a large number of individual devices now available on the commercial market.

Another object of this invention is to provide a boat construction which may be used separately for water sports as well as for transportation between shore and a boat anchored offshore.

A still further object of this invention is to provide a convertible boat construction which may be used for transportation, as a life raft, has a size and shape suitable for storage on board a larger boat and may be broken down into its component parts whereby the component parts may be used to serve useful functions on board a larger boat in place of a multiple number of accessories.

Another object of this invention is to provide a convertible assembly which may be used as a pontoon when filled with a gas fluid medium or as a stabilization unit when containing a liquid fluid medium.

SUMMARY OF THE INVENTION

The assembly of this invention includes at least two elongated units mounted on a rigid support means. One feature of this invention is directed to the specific structure of at least one of the units. This unit is a combination of a collapsible, elongated container adapted to receive a fluid medium therein and an elongated frame structure having an open configuration for receiving the collapsible container. Fastening means are provided for attaching the container within the frame structure during use. The container being attached to the frame structure forms a combination that may be used as a pontoon when the container is inflated with a gas fluid medium and may be employed in other uses when the container holds a liquid fluid medium.

When the two elongated units are mounted on a rigid support means, the assembly may be used as a dinghy or boat on the water surface. Because the assembly may be broken down into its component parts, it may be easily stored on board a larger boat. Once broken down, the separated unit or units may be used for various other functions. Wheels or runners may also be placed on the support means to provide a vehicle for land or ice.

Other features of the invention are directed to the manner in which the separated units may be attached to the mast of a sailboat for providing additional support thereto and effecting the hiking-out of additional weight from the side of a sailboat that is underway.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a perspective view of an assembly made in accordance with this invention;

FIG. 7 is a sectional view showing detail of an assembly made in accordance with this invention;

DESCRIPTION OF SPECIFIC EMBODIMENTS

Figures 2, 6:
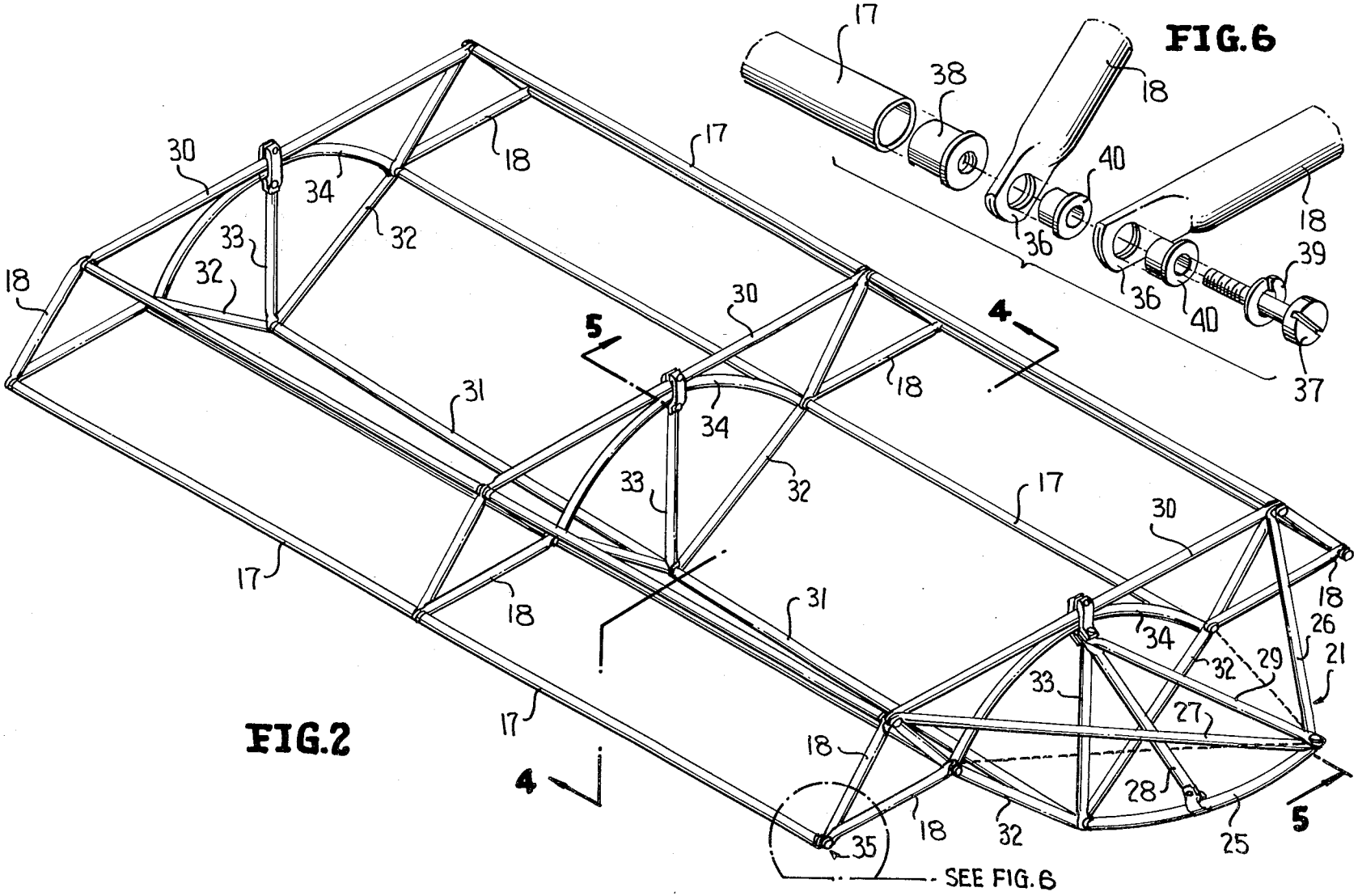
FIG. 2 is a perspective view of the assembly of FIG. 2.
FIG. 6 is an exploded view of the connection as shown in FIG. 2.
Figure 3:
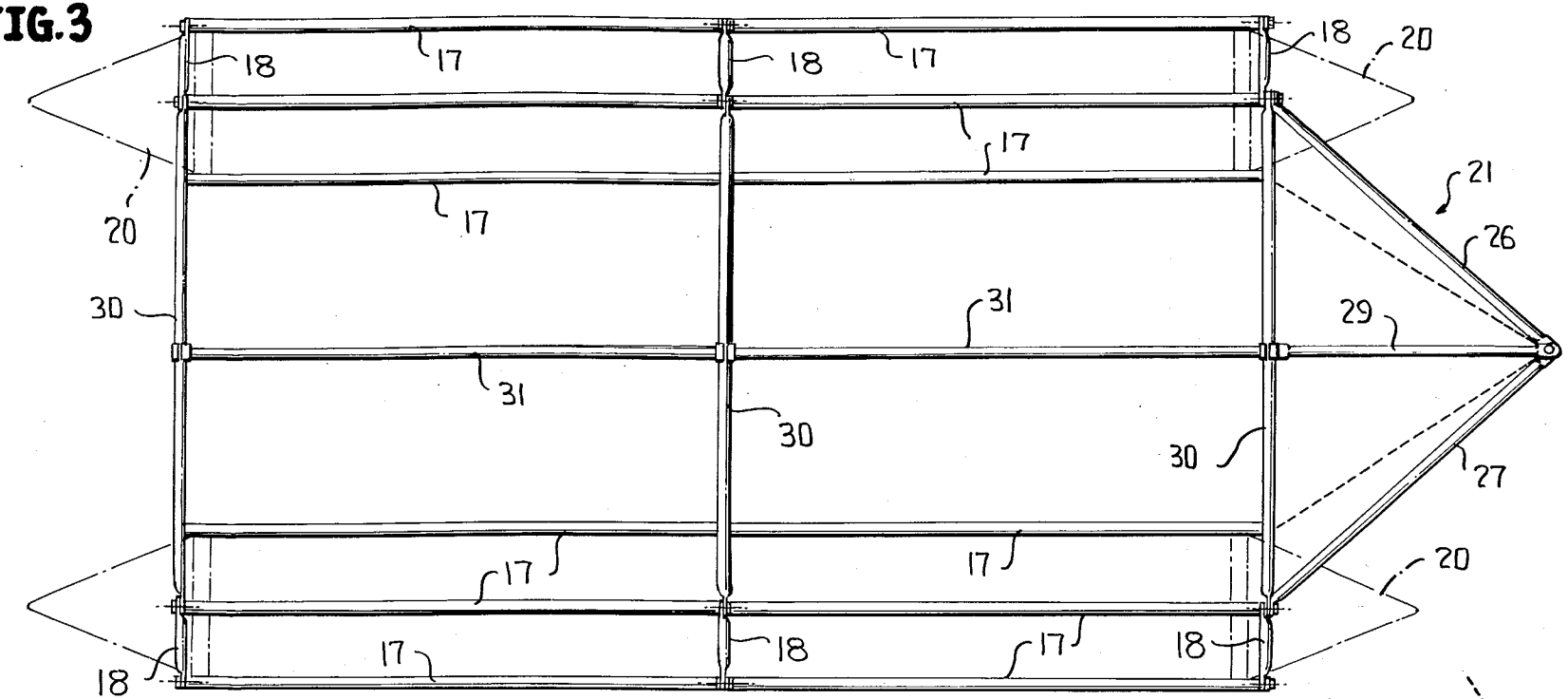
FIG. 3 is a top plan view of the assembly of FIG. 2.
Figure 5:
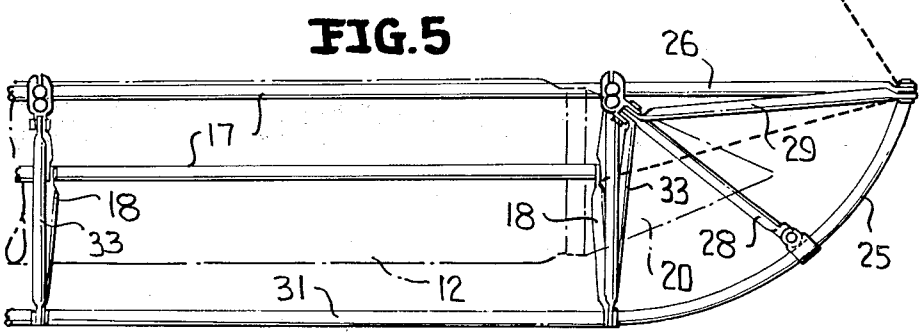
FIG. 5 is a sectional view along line 5—5 of FIG. 2.
Figure 4:
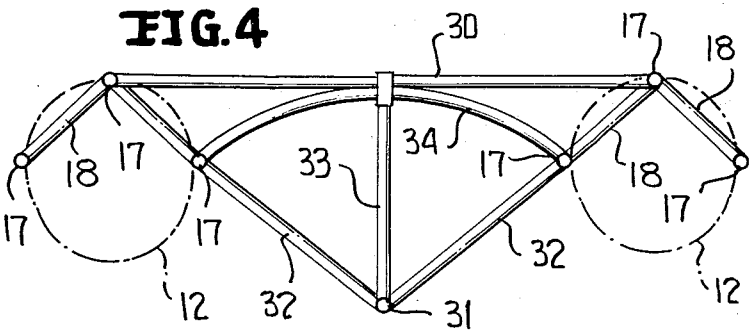
FIG. 4 is a sectional view along line 4—4 of FIG. 2.

More specifically, a boat assembly, generally designated 10, incorporates the structure made in accordance with this invention. The boat assembly 10 includes a hull 11, a bow portion 21, a deck portion 22 and a mast 23. A pontoon construction extends along both sides of the assembly 10 and includes a plurality of flexible containers 12 filled with a fluid medium. In this particular embodiment, the fluid medium is air and the containers 12 provide buoyancy to the assembly 10. Cones 20 are disposed at the front and rear ends of the pontoon assembly in a manner that is known in the prior art. The mast 23 may be connected to the support members of the assembly 10 in any known manner. The construction as shown in FIG. 1 may be elongated or shortened by simply adding or eliminating more pontoon modules and support members as desired. The width or beam may also be modified when lengthening the boat by either using a different length of transverse support member between the parallel pontoons, or by having telescoping cross members.

Figure 8:
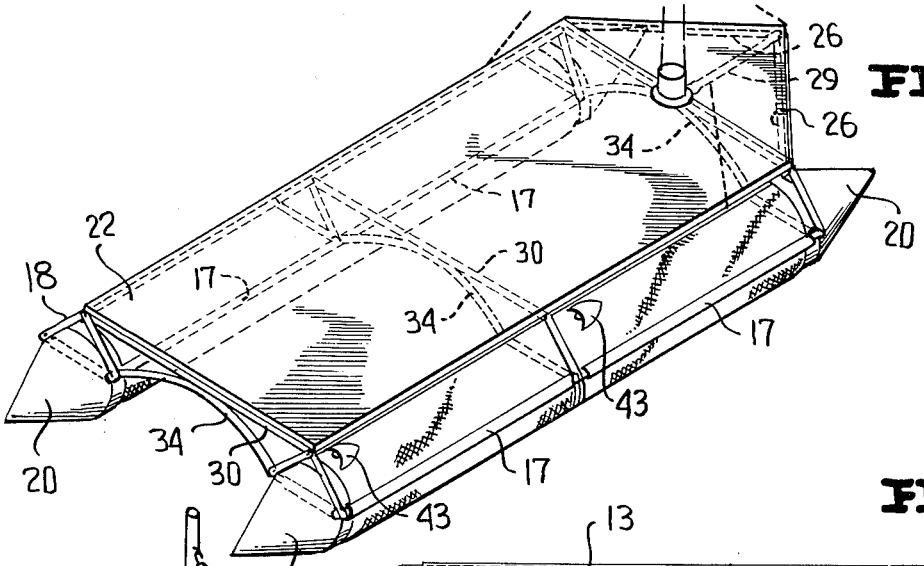
FIG. 8 is a perspective view of another embodiment of this invention.

The hull 11 as shown in the assembly 10 is a single hull construction known in the prior art as a cathedral hull. The single hull assembly as shown in FIG. 1 may be converted to a multi-hulled assembly as shown in FIG. 8. This convertibility characteristic is accomplished through the unique superstructure as described hereinbelow. A hull covering 45 is used to complete the deep hull configuration. The hull covering may also be inflatable. The boat assembly of this invention is also capable of achieving all known forms of single hull designs, e.g., the deep V; semi-V; modified V; cathedral (also known as the tri-hull); tunnel hull; round bottom boat; flat bottom boat; as well as all of the multi-hulled configurations of a trimaran and a catamaran.

The superstructure of assembly 10 is shown in perspective in FIG. 2 and includes a simple fastening together of pontoon modules in any desired configuration. The basic module of the instant invention includes linear longitudinal support members 17 and short transverse support members 18 which are interconnected at their ends through the joint fastening mechanism 35. As is evident in the drawings, the elongated frame structure has a plurality of parallel linear support members 17 that are laterally spaced with respect to each-other and an end frame portion including transverse support members 18. An end frame portion is shown located at each end of the support members 17. The flexible containers 12 have a structure effective to receive both liquid and gas mediums and include longitudinal fabric tunnels 13 through which the longitudinal support members 17 extend. As shown, the collapsible, elongated containers 12 have a longitudinal axis and opposite end surfaces **12*a* transverse to the longitudinal axis. The outer end tunnel 16 encases a short transverse support member 18. The sectional view as shown in FIG. 7 shows the relationship existing between the longitudinal support member 17 and the outer longitudinal tunnels 13 which are connected to the flexible container 12**.

As is evident in the drawings, the fastening means in assembly 10 include tunnels 13 and 16 for attaching the longitudinal containers 12 to the frame structure with the longitudinal axis of each container 12 being disposed substantially parallel to the linear support member 17. Additionally, each of the end surfaces **12*a* are disposed adjacent an end frame portion. Consequently, the frame structure provides support along both the longitudinal surface and end surfaces 12*a* when the containers 12 are within the frame structure during use. A horizontal web 14 and a vertical web 15 are connected to the inside of the flexible container 12 to provide support therein. The container 12 will retain its shape much more effectively through the use of the webs 14 and 15**. If desired, it is possible to form either one of these webs as a single solid piece to compartmentalize the inside of the container.

Figure 10:
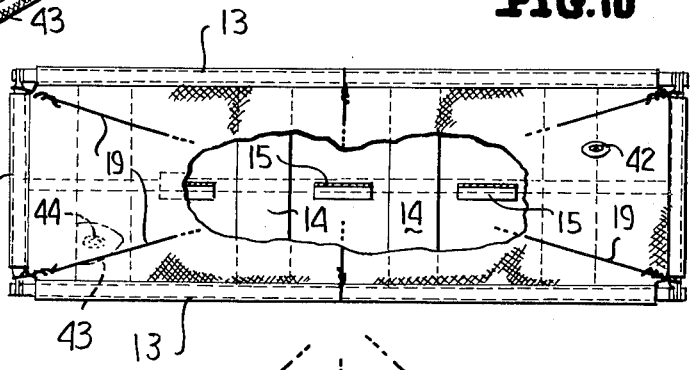
FIG. 10 is a top plan view of the module of FIG. 9.
Figure 11:
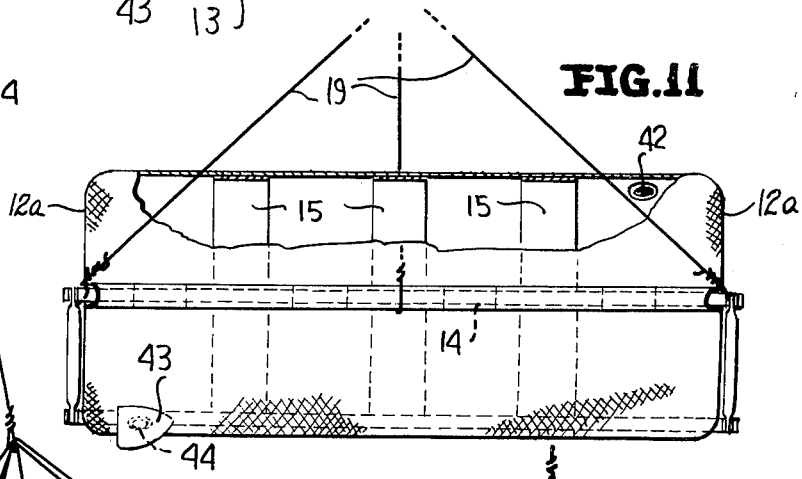
FIG. 11 is a side elevational view of the module as shown in FIG. 9.

As shown, container 12 is attached to the frame structure with one of the linear support members 17 extending longitudinally along one side of the container with the side opposing said one side of the container being free of a support member 17. See particularly FIG. 7 where this arrangement is used as a pontoon and FIGS. 9, 10 and 11 where the container 12 is used to hold a liquid medium providing ballast.

The pontoon modules are connected by the cross members 30 and curved support members 34. In the embodiment as shown in FIG. 1 and FIG. 2, the single hull configuration includes longitudinal keel members 31, side support members 32 and keel braces 33. In addition, the bow portion 21 includes a front bow support member 25, top side support members 26 and 27 and bow braces 28 and 29. When it is desired to have a multi-hulled configuration as shown in FIG. 8, it is simply necessary to remove the bow portion 21 which includes braces 28 and 29 and support members 25, 26 and 27 together with the longitudinal keel support members 31, side support members 32 and keel brace members 33. When these braces and support members are removed, the resultant structure will be a through-passage configuration which is commonly referred to as a catamaran. Alternatively, it is simply necessary to remove the bow member 25, brace 28, and keel braces 33 then swing upwardly longitudinal keel support members 31 and side support members 32, to awaiting fasteners in the center of members 34. The boat will move about on the surface on the water through the buoyancy provided by the flexible containers 12 that have been filled by air.

The convertibility of the assembly made in accordance with this invention has been facilitated through the use of a fastening mechanism 35 as shown in FIG. 6. The flattened end portions 36 on each one of the support brace members may be placed in juxtaposed relationship with a bolt 37 extending therethrough into a plug 38. A grommet 40 and washer 41 are used to separate each of the flattened ends 36. A lock washer 39 will maintain the bolt 37 in place while the assembly is in use. When it is desired to remove a pontoon module from the assembly or to convert from between a single hull and double hull construction, it is simply a matter of making the simple manipulation of the fastening means to effectuate the desired results. Other types of fasteners such as set screws, bolts, snap-out pins placed into pre-drilled holes might also be used for strength and rigidity as alternatives to the fastening mechanism of this embodiment.

The deck covering 22 may include any snap-on fastening mechanism available in the prior art. That is, it is simply a matter of manipulating a simple fastening mechanism to remove the covering from the assembly of this invention for its other uses, e.g., when it is to be used for a shower curtain; for a cockpit tent which converts the cockpit into additional cabin and sleeping facilities; for an air ventilator covering, etc.

It is within the contemplation of this invention to provide a set of wheels or a set of runners onto the support structure so as to enable the assembly to be used for travel over land or over the surface of ice or snow. Any conventional mechanism might be used to attach wheels or runners to the basic frame construction to effectuate the desired results.

Figure 9:
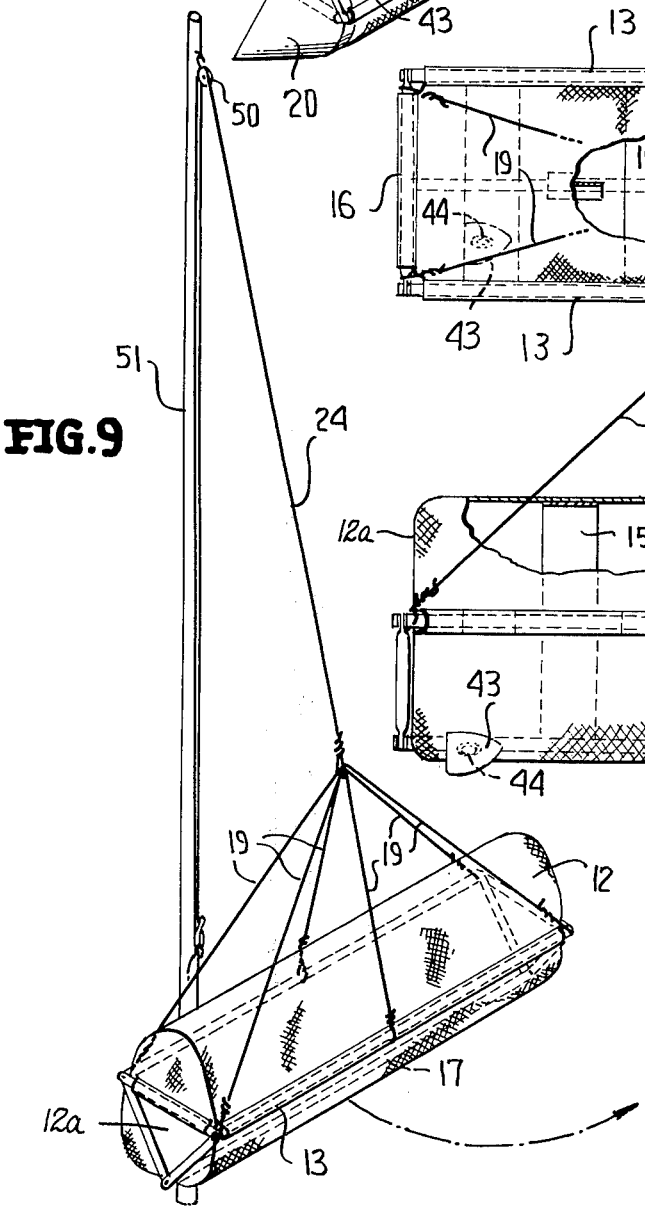
FIG. 9 is a perspective view of a module made in accordance with this invention.

The assembly 10 may be dismantled into its component parts such as shown in the construction of the module of FIG. 9. In this specific embodiment, the module is being used as a ballast on board a sailboat. That is, the container 12 is filled with liquid medium and the additional weight is used to offset the tilting of the sailboat when underway. Connecting lines 19 extend from the module and attach to the shroud line 24. The shroud line 24 is attached over a pulley 50 located toward the top of the mast 51 on the sailboat in a manner known in the prior art. The line 24 would extend through pulley 50 and back downwardly to a winch, block and tackle or a cleat 52. The amount of displacement of the module may be controlled with respect to the gunwales of the sailboat in this manner. The module may be used as a ballast by having the module disposed along the deck of the sailboat itself. It need not be connected to the shroud 24 for this use. It may also be pushed or carried outwardly from the side of the boat to effectuate the same result as a man hiking outwardly from the gunwales as is well known in the sport of sailing.

The cross members 30, 34, can be the extendible support of the module used as a stabilizer. The cross members 30, 34, used in conjunction with a cable and winch, give the option of utilizing at least two methods or principles to extend the ballast outwardly from the gunwales of the boat; first, the simple principle of a crane, and second, the principle of scissors wherein one end of the two cross members is allowed to run smoothly along the angles of connecting lines 19. The other end of the two cross members 30 and 34 can be attached to the gunwales of the sailboat, being allowed to pivot horizontally like the center of a pair of scissors.

When filled with water, the module may very well be used as a sea anchor by simply dropping the same over the side and maintaining a connecting line to the boat itself. Once the boat is anchored, it is possible to utilize the same ballast or trim stabilizer as an underwater stabilizer and reduce the boat's pitch and roll. In this instance, the module is detached and partially emptied so that the top has a flat or concave configuration. At least one of the modules is submerged into the water using the same cross members, or any pole, to extend the shroud away from the gunwales. In other words, it is possible to use the module made in accordance with this invention to stabilize any type of boat while it is either at anchor or while it is underway. This is a capability that is shared by no other structure available in the prior art.

The flexible container module may be made any desired length, width, height and shape, depending upon the desired size and weight when filled with a medium such as air or liquid. Such a module as described hereinabove has been constructed in accordance with this invention with length L of 4 feet, and overall width W of 15 inches and an overall height H of 18 inches. Straps (not shown) may be used to support the container 12 along its length. Such straps would extend underneath the container 12 and between parallel support members 17.

It is seen that the container of the module as shown in FIG. 9 may be used to provide additional water storage. The frame structure may be used in conjunction with a block and tackle for lifting material on board the ship. The flexible container 12 would be deflated in such an instance. It would also be possible to mount a module with water located in the flexible container 12 in such a way as to provide a shower facility on board ship. It would simply be necessary to place a curtain structure such as the deck portion 22 to form a shower stall underneath the upraised module and place a shower head onto a valve allowing the water to run out of the flexible container 12 as desired. It is clear that the structure of the module of FIG. 9 might also be used as a boatswain's chair. Many other uses may be made of such a module structure as may be deemed appropriate by the user.

It is clear that the use of a frame structure in combination with an inflatable capacity for the assembly as disclosed herein has many advantages over a purely inflatable boat as is available in the prior art. Such purely inflatable boats may not be used to effectuate the desired conversion between single hull and multihulled boats nor are they readily adaptable to use on land or ice. Furthermore, the completely inflatable boats of the prior art may not be dismantled in such a way as to provide the additional accessory items as are provided by the module that is disclosed herein and shown specifically in FIG. 9. At the same time, the disclosed assembly retains the advantages of an inflatable boat when compared to one made out of less flexible material such as fiberglass or wood.

The container 12 includes a standard air valve 42 a scoop structure 43 and a one-way valve 44. With this structural configuration, the container 12 may be placed over the side of a boat while underway to scoop water into the one-way valve 44. As shown, the container 12 includes valve means for introducing and exhausting both liquid and gas mediums.

Figure 12:
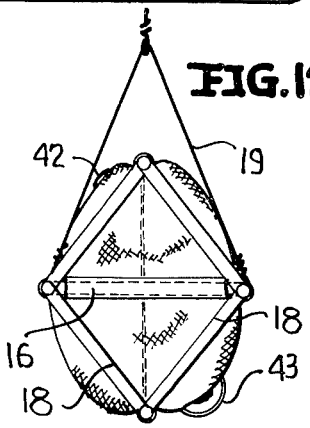
FIG. 12 is an end view of another embodiment of a module made in accordance with this invention.

In the embodiment of FIG. 12, a longitudinal member 17 and four transverse support members 18 are taken from another pontoon cylinder and attached as shown. It is also possible to secure a member 17 to the center of member 18, making a flat or concave top configuration, thereby providing a further strengthening effect. In this embodiment, members 32 could be extended and attached to the very bottom of the container, thereby allowing the formation of a very deep V-hull configuration.

While an assembly for use in recreational activities has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. An assembly for use in recreational activities comprising:

a. a collapsible, elongated container having a longitudinal axis and opposite end surfaces transverse to the longitudinal axis, b. said container having a structure effective to receive both liquid and gas mediums therein and including valve means for introducing and exhausting both liquid and gas mediums, c. an elongated frame structure having a plurality of parallel linear support members wherein each support member is laterally spaced with respect to any other lateral support member and a separate end frame portion connected at each end of said support members to form an open structural configuration for receiving the collapsible container, and d. fastening means for attaching the elongated container to the frame structure with said longitudinal axis disposed substantially parallel to the linear support members and each said end surface being crossed by an adjacent end frame portion to support the container within the frame structure during use, e. the container being attached to the frame structure with one of said linear support members extending longitudinally along one side of the container with the side opposing said one side of the container being free of a support member whereby the assembly may be used as a pontoon when the container is inflated with a gas fluid medium and is employable in other uses when the container is not inflated or holds a liquid fluid medium.

2. An assembly as defined in claim 1 wherein the collapsible container includes first and second valve means disposed at different locations on the surface of said container, said first valve means being effective to introduce a fluid medium while the second valve means is effective to exhaust a fluid medium.

3. An assembly as defined in claim 1 wherein the collapsible container includes valve means for introducing and exhausting a liquid medium and valve means for introducing and exhausting a gas medium.

4. An assembly as defined in claim 1 wherein the collapsible container includes a first valve means for introducing and exhausting a fluid medium disposed on one side of the container and a second valve means for introducing and exhausting fluid medium on an opposing side of said container.

5. An assembly as defined in claim 4 wherein one of the valve means is disposed on the side of the container having a linear support means, said valve means includes a scoop means disposed around the valve opening for directing flow of a liquid medium.

6. An assembly as defined in claim 1 wherein the frame structure includes means for attaching the assembly to a shroud line that is connected to the mast of a sailboat.

7. An assembly as defined in claim 1 wherein the collapsible container includes a flexible support means located inside the container so that the shape of the container will be maintained in a desired configuration when filled with a fluid medium.

* * * * *